US005787940A

United States Patent [19]

Bonn et al.

[11] Patent Number: 5,787,940

[45] Date of Patent: Aug. 4, 1998

[54] CRYOGENIC FLUID SYSTEM AND METHOD OF PUMPING CRYOGENIC FLUID

[75] Inventors: John W. Bonn, Hilliard, Ohio; Anker Gram, Vancouver, Canada

[73] Assignee: Process Systems International, Inc., Westborough, Mass.

[21] Appl. No.: 646,882

[22] Filed: May 8, 1996

Related U.S. Application Data

[60] Continuation-in-part of Ser. No. 450,085, May 25, 1995, Pat. No. 5,551,488, which is a division of Ser. No. 294,084, Aug. 22, 1994, Pat. No. 5,477,690, which is a division of Ser. No. 39,908, Mar. 30, 1993, Pat. No. 5,411,374.

[51] Int. Cl.[6] ..... B65B 1/04

[52] U.S. Cl. ..... 141/18; 141/2; 141/5; 141/21; 141/44; 62/50.1; 62/50.4; 62/45.1; 62/47.1; 220/501

[58] Field of Search ..... 141/1–5, 7, 18, 141/21, 44, 198, 325; 137/575; 123/541, DIG. 12, 527, 525; 417/53, 404, 901; 62/7, 50.1, 46.2, 50.4, 47.1, 45.1, 54.1, 55.5; 220/4.12, 501, 4.14; 222/385

[56] References Cited

U.S. PATENT DOCUMENTS

| | | | |
|---|---|---|---|
| 3,012,629 | 12/1961 | Walker et al. | 62/911 |
| 3,109,293 | 11/1963 | Williams et al. | 62/50.6 |
| 3,131,713 | 5/1964 | Kelley | 62/50.6 |
| 3,433,028 | 3/1969 | Klee | 62/50.7 |
| 3,633,372 | 1/1972 | Kimmel et al. | 62/49 |
| 3,946,572 | 3/1976 | Bragg | 62/50.1 |
| 4,175,395 | 11/1979 | Prost et al. | 62/52 |
| 4,321,796 | 3/1982 | Kohno | 62/52 |
| 4,479,363 | 10/1984 | Gibson et al. | 62/63 |
| 4,932,214 | 6/1990 | Nieratscher et al. | 62/50.6 |
| 5,121,609 | 6/1992 | Cieslukowski | 62/50.4 |
| 5,127,230 | 7/1992 | Neeser et al. | 62/7 |
| 5,214,925 | 6/1993 | Hoy et al. | 62/50.6 |
| 5,325,894 | 7/1994 | Kooy et al. | 141/4 |
| 5,360,139 | 11/1994 | Goode | 222/40 |
| 5,373,700 | 12/1994 | McIntosh | 62/48 |
| 5,390,646 | 2/1995 | Swenson | 123/525 |
| 5,409,046 | 4/1995 | Swenson et al. | 141/11 |
| 5,415,001 | 5/1995 | Powars | 62/50.2 |
| 5,421,160 | 6/1995 | Gustafson et al. | 62/7 |
| 5,465,583 | 11/1995 | Goode | 62/50 |
| 5,682,750 | 11/1997 | Preston et al. | 62/50 |

OTHER PUBLICATIONS

Toby L. Perelmuter, "First 'Self-Serve'LNG Vehicle Fueling Station Installed" (Cryo Gas International), Jul. , 1995, pp. 9–12.

Jeff Beale, "Design and Operation of the World's First 'Self-Serve'LNG Vehicle Refueling Station", Presented at the 13th National NGV Conference Exhibition (Oct. 15, 1995).

*Primary Examiner*—David J. Walczak
*Assistant Examiner*—Timothy L. Maust
*Attorney, Agent, or Firm*—Richard P. Crowley

[57] ABSTRACT

A system and method for the delivery of cryogenic fluid, more particularly a cryogenic fuel, such as, for example, but not limited to an liquified natural gas (LNG), to a cryogenic fluid using source, and more particularly an LNG fuel source, and even more particularly an LNG fuel-operated engine. The system includes a source of a cryogenic fluid, more particularly an underground tank and with a liquid level within the underground tank source. The system includes a delivery pump to deliver cryogenic fluid from the underground tank source, to a cryogenic using source, typically an LNG fuel source above the underground tank source, with the pump located below the liquid level of the cryogenic fluid in the cryogenic fluid fuel tank. The system includes a sump containing cryogenic fluid, and the delivery pump positioned and immersed in the cryogenic liquid in the sump, and a conduit and valve to deliver cryogenic fluid through the use of the cryogenic fluid flow pump from the underground cryogenic fluid tank source to an above-ground or level using source, such as an LNG operated vehicle.

38 Claims, 2 Drawing Sheets

CRYOGENIC FLUID SYSTEM AND METHOD OF PUMPING CRYOGENIC FLUID

This is a continuation-in-part of copending application Ser. No. 08/450,085 filed May 25, 1995 now U.S. Pat. No. 5,551,488 which is a divisional application of U.S. Ser. No. 08/294,084 filed Aug. 22, 1994 now U.S. Pat. No. 5,477,690 which is a divisional of U.S. Ser. No. 08/039,908 filed Mar. 30, 1993 now U.S. Pat. No. 5,411,374, issued May 2, 1995.

BACKGROUND OF THE INVENTION

Cryogenic fluids, such as liquified oxygen, and particularly cryogenic hydrocarbons used in fuel dispensing operations, such as compressed and liquified hydrocarbon gas, typically natural gas, which is mostly methane, have been used for powering engines, and particularly vehicle engines, for some time.

In particular, liquified natural gas, or LNG, is normally stored at temperatures of between −40° F. and −200° F., and at pressures of about 50–100 psig. It is most desirable to provide for safe and effective ways in which LNG may be safely handled and delivered and used in LNG operating engines, particularly in LNG-powered vehicles, such as heavy duty trucks. For example, the American Trucking Associations Foundation, Inc., has provided for "Recommended Practices for LNG Powered Heavy Duty Trucks", by an ATA Alternative Fuels Task Force subcommittee, hereby incorporated by reference in its entirety. The purpose of the proposed recommendations is to establish uniform practices for the construction, operation and maintenance of LNG vehicles, such as heavy duty trucks.

A cryogenic fluid pump system and method of pumping cryogenic fluids using two-compartment storage tanks from an underground storage tank, have been disclosed and claimed in U.S. Pat. No. 5,411,374, issued May 2, 1995, and U.S. Pat. No. 5,477,690, issued Dec. 26, 1995. U.S. Pat. No. 5,411,374 is particularly directed to cryogenic fluid pump and systems, employing a pump with reciprocating piston, which pumps vapor and liquid efficiently, even at negative feed pressures, permitting the pump location outside the liquid container. The system and method also includes employment of a vapor-liquid compartment storage tank connected with a communicating conduit, and a control system wherein when the liquid compartment becomes substantially full, a sensing signal is sent to stop or reduce the flow of the cryogenic fluid, thus preventing overfilling of the two-compartment storage tank. The patents also involve a method of pumping cryogenic fluid from the source of cryogenic fluid, such as from an underground storage tank employing a positive displacement cryogenic pump, with a pump piston adapted for reciprocating movement at essentially constant velocity. The system and method of the storage tank vapor-liquid LNG container, the method of filling and method of filling LNG vehicles employing LNG fluid from an underground source and into an LNG storage container on the vehicle, are set forth in the foregoing patents.

It is desired to provide for a new and improved system and method for the delivery of cryogenic fluid, particularly LNG fluid, from a cryogenic fluid storage system, particularly an underground LNG storage tank, to a cryogenic fluid fuel operating system, such as for example, vehicles like LNG powered trucks and which system and method provides for improved efficiency and safety.

SUMMARY OF THE INVENTION

The invention relates to a system for the delivery of cryogenic fluid, to a cryogenic using source, and for a method for such delivery. In particular, the invention relates to a system for the delivery of LNG from an underground storage tank, to an LNG-operated vehicle.

The invention relates to a system and method for the delivery of cryogenic fluid, more particularly a cryogenic fuel, such as, for example, but not limited to an LNG, to a cryogenic fluid using source, and more particularly an LNG fuel source, and even more particularly an LNG fuel-operated engine. The system and method comprises a source of a cryogenic fluid, more particularly an underground tank and with a liquid level within the underground tank source. The system includes a delivery pump to deliver cryogenic fluid from the underground tank source, to a cryogenic using source, typically an LNG fuel source above the underground tank source, with the pump located below the liquid level of the cryogenic fluid in the cryogenic fluid fuel tank. The system includes a sump containing cryogenic fluid, and the delivery pump positioned and immersed in the cryogenic liquid in the sump, and a conduit and valve means to deliver cryogenic fluid through the use of the cryogenic fluid flow pump from the underground cryogenic fluid tank source to an above-ground or level using source, such as an LNG operated vehicle.

The method for the delivery of a cryogenic fluid from a tank source to a cryogenic fluid-using source comprises positioning and immersing a pump in a sump filled with cryogenic fluid; and pumping the cryogenic fluid from the tank source by the pump in the sump at a selected saturated pressure to a remote cryogenic fluid-using source. The method includes heating the cryogenic fluid from the pump to a selected set temperature prior to delivery to the cryogenic fluid using source, and controlling the temperature of the cryogenic fluid from the heater by a thermocouple means connected to the heater. The method also includes providing an underground insulated tank of cryogenic fluid; positioning the sump and pump beneath the ground and the cryogenic fluid-using source at or above the ground. Optionally, the sump may be positioned separate from the underground tank source. The method includes draining all connecting conduits from the pump to the cryogenic fluid using source back to the sump after completion of the pumping step. In the method the cryogenic fluid comprises LNG, and includes pumping the LNG into a two-compartment vapor liquid LNG storage tank on an LNG-using vehicle.

Optionally and preferably, the system and method involves the use of a cryogenic fluid preheater downstream of the delivery pump. Generally, the preheater includes an immersion heater, that will control the temperature of the cryogenic fluid therein, in order to saturate the fluid at different pressures for the onboard systems on which the cryogenic fluid is to be delivered. An immersion heater, usually a flow-through cryogenic fluid immersion heater, is most desirable in order to provide for cryogenic fluid of a selected saturation pressure. The underground storage tank which stores cryogenic fluid such as LNG, will be storing the fluid at about 60 lbs. psig, while the onboard system, such as an LNG-operated vehicle, would require a saturated LNG, at about 100 psig. The use of a flow-through immersion heater in the system, provides for the movement of the cryogenic fluid from the desired saturated pressure of the storage tanks to the higher saturated pressure of the onboard vehicle. Thus, the immersion heater provides additional heat as required, as a cryogenic flow-through heater, and which preheater has a thermocouple means, such as at the exit of the immersion heater, to provide for the controlled saturated pressure of the cryogenic fluid to be delivered.

The cryogenic fluid may be stored in an underground storage tank, without the use of any exterior insulation.

Generally, such a storage tank would be a double-walled vacuum-type tank with an inner and outer tank with a vacuum in between, which, installed in the ground, would be sufficient without the use of additional insulation. The system is arranged so that when the cryogenic fluid system is not operating; that is, not pumping to deliver onboard cryogenic fluid, the lines above the underground tank, which may be filled with the cryogenic fluid, are permitted to drain back into the underground tank, so that no cryogenic liquid remains in the line after filling of the onboard cryogenic fluid; say, for example, to an LNG powered truck. Further, in the system, all valves, controls and sensors are placed below ground level, in order to provide for additional safety feature.

The system also includes a sump for the operating pump, with the operating pump being totally submerged in the cryogenic fluid in the sump. The employment of the operating or delivery pump, whether it is a double acting, reciprocating, net suction pressure pump as described in the Anker Gram patent, or a centrifugal pump or other type of cryogenic delivery pump, provides for a precooled pump, and avoids the need to encase the pump in exterior insulation, which exterior insulation must be removed and replaced during any repair and maintenance of the pump. With the pump submerged in a sump of the cryogenic fluid, then merely the cryogenic fluid must be removed for repair and maintenance on the pump, which is far more efficient than removing and installing insulation. In addition and importantly, the submerging of the pump in a sump precools and preconditions the pump, so that the pump is ready for operation very quickly, since it has been precooled.

Employment of the sump may operate within the main cryogenic fluid storage tank, or preferably the sump may be an independent sump that can be isolated from the main cryogenic fluid storage tank, and particularly where the independent sumps are employed, it is an advantage for service and maintenance of the submerged pump. For example, a reciprocating driven pump or centrifugal pump may be installed on the bottom of the sump, and maintained at operating temperatures at all times. The sumps may be isolated from the main cryogenic fluid storage tank by a valve located at the bottom, and an equalizing valve at the top of a sump. A vacuum space may separate the sump from the storage tank in different types of configurations to permit warming of the sump without affecting the main cryogenic fluid storage tank. A separate sump for the pump and system valving has an advantage over the submerging of the pump directly into the storage tank. The immersion heater positioned in the sump will also help control the temperature of the LNG to provide for the correct saturated liquid at different pressures for the onboard system. The sump may also be used for the addition of a very high pressure-type pump, for example, 4–5000 psig as required.

Generally, the conditioning or immersion preheater is located downstream of the pump and the sump. The heater may be mounted to the top sump flange, and insulated by a vacuum in the space between the top flange and the immersion preheater. The heater is mounted to the pump assembly by a flange located at the bottom of the sump piping. Electrical leads from the immersion heater are connected to the heater elements and then passed through a vacuum jacketed plug, to a connector located at the top of the sump flange. A control thermocouple is located downstream of the heating elements of the immersion heater with connecting controls, to control the temperature of the cryogenic fluid to a predetermined set point, or to a predetermined saturated pressure as required, which set point may vary from vehicle to vehicle based on the conditional requirements of the LNG operated vehicle.

Also, and preferred, a fail-close electropneumatic or hydraulic valve is located in the vacuum space downstream of the control thermostat to isolate the sump pump and piping from the above-ground piping when the pump or system is not operating. The closed electropneumatic or hydraulic valve is open during the cool-down operation or when filling cryogenic fluid storage tank on board the vehicle, to provide a cryogenic fuel operating station. A fail safe open valve is also located at the outlet of the immersion preheater and exits into the sump volume. The fail safe open valve is a bypass valve that allows the pump to operate a closed loop back to the sump without flowing through the rest of the system. This valve also operates as a drain-valve for all piping located above ground. This draining operation is required after each filling operation, so that all cryogenic liquid from the above-ground lines will be drained back into the underground storage tank system to make the cryogenic fluid system safer and to reduce the heat leak of the overall system.

The invention also includes a method of delivering a cryogenic fluid such as LNG to a cryogenic fluid using system, such as an LNG engine, particularly an LNG operated vehicle like a truck, and which method comprises providing a storage tank, such as an underground storage tank, for the storage of cryogenic fluid to be used, and immersing a pump for the pumping of the cryogenic fluid from the underground storage tank in a sump containing cryogenic liquid and pumping cryogenic fluid from the pump from the tank to a cryogenic fluid using system, such as an LNG vehicle at a selected saturated pressure. The method also includes immersing the pump in a sump which is independent from the underground storage tank, and which sump is insulated, and which optionally and preferably may include an immersion preheater, with controls, for the heating of the cryogenic liquid, so as to raise the saturated pressure of the cryogenic fluid from the underground storage tank to the desired pressure for the cryogenic using system.

The method and system of the invention may be employed for the delivery of the cryogenic fluid such as LNG, for any fluid operating type system requiring cryogenic fluid, but more typically is directed to a cryogenic fluid fuel, and particularly to LNG for the operation of LNG-operated engines, such as an LNG engine on board a vehicle having a separate fuel pump, and also containing an onboard LNG storage tank, such as a vapor-liquid storage compartment tank on the vehicle.

The invention will be described for the purposes of illustration only in connection with certain systems and methods; however, it is recognized that various modifications, changes, additions and improvements may be made to the illustrated system and method all falling within the spirit and scope of the invention.

DESCRIPTION OF THE EMBODIMENTS

Figure 1:
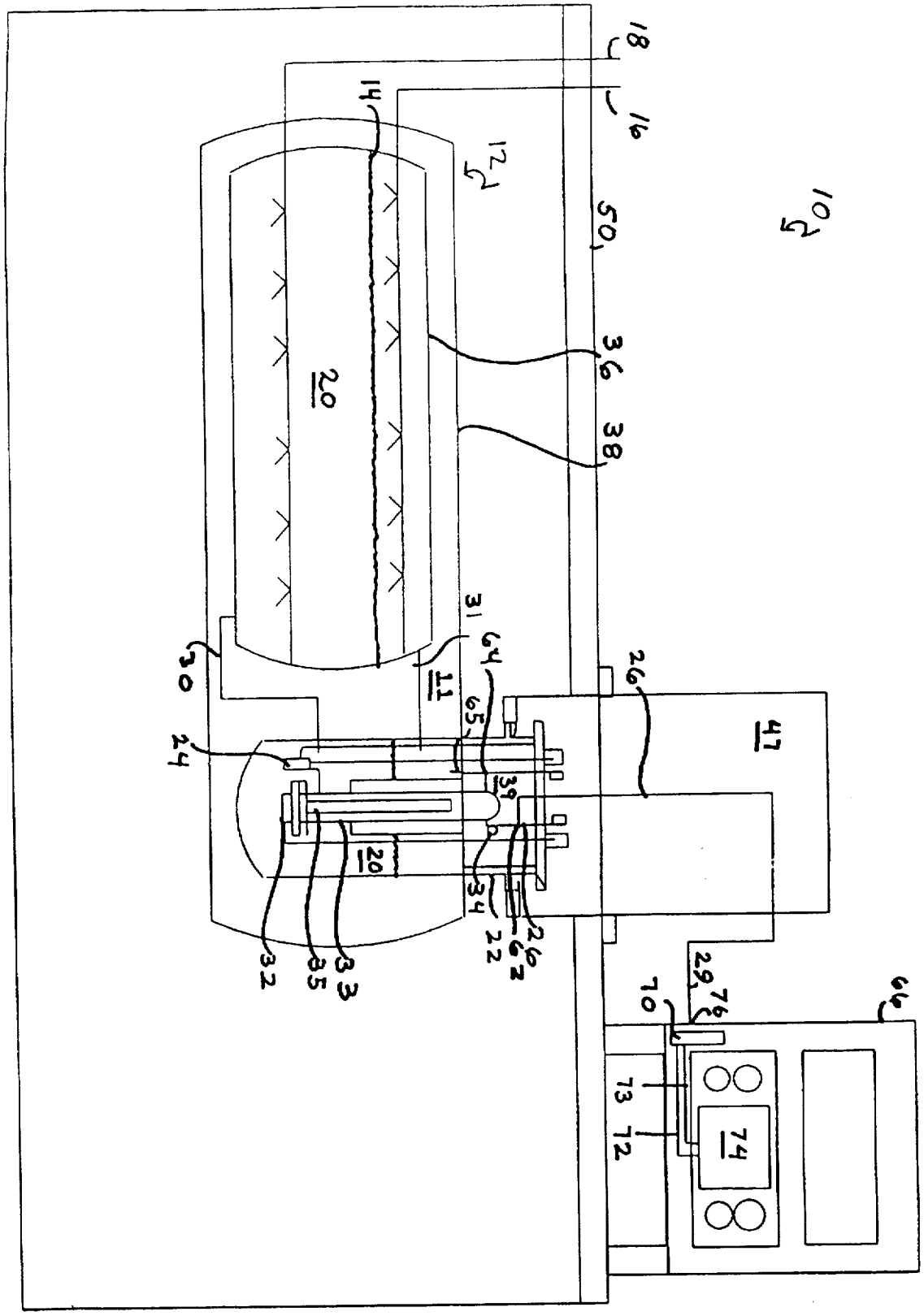
FIG. 1 is a schematic illustration of the system of the invention.
Figure 3:
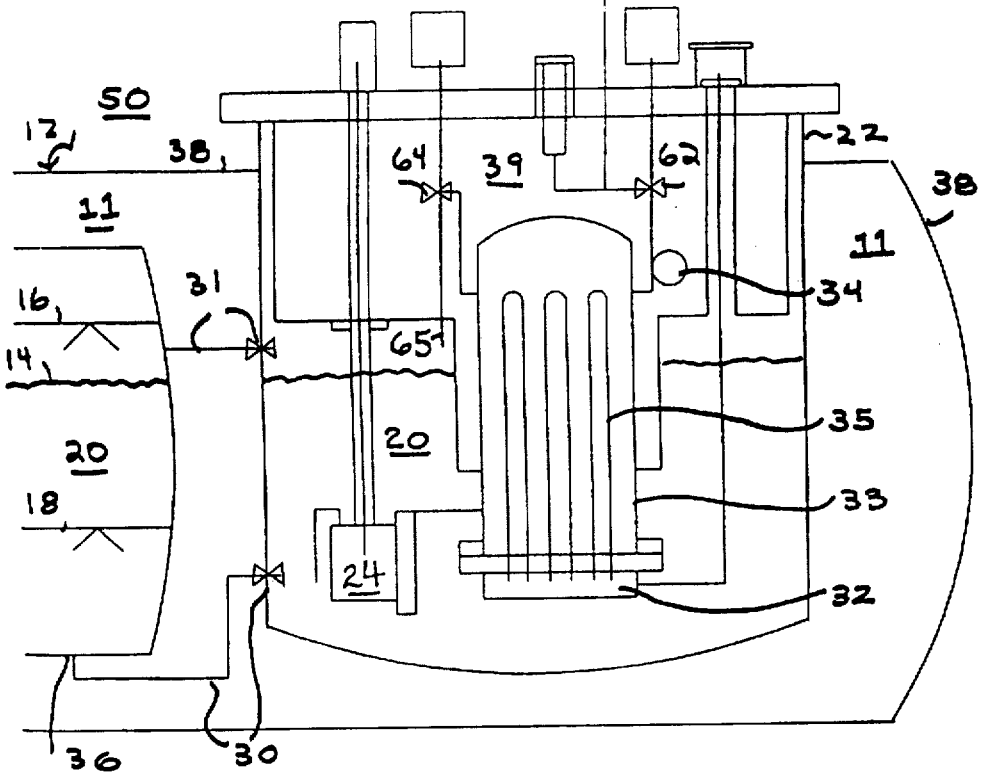
FIG. 3 is an enlarged sectional portion of FIG. 1 wherein the sump is within the vacuum space of the main storage tank.

In the drawings, FIG. 1 and FIG. 3 show the system for the delivery of cryogenic fluid of the invention 10 with an underground cryogenic fluid fuel tank 12 having an inner tank 36 and an outer tank 38 with a vacuum insulating space 11. Top 16 and bottom 18 fuel fill conduits with valves fill the inner tank 36 with a cryogenic fluid 20 to a liquid level 14. The tank is below ground 50 and has an LNG vapor conduit line 31 and liquid conduit line 30 with valves connected thereto. The conduit lines 30 and 31 enter into a sump 22, within vacuum space 11, and which sump 22 contains a pump 24 and heater 33. The delivery pump 24 is positioned below the liquid level 14 of the cryogenic fluid 20 in the cryogenic fluid fuel tank 36. The pump 24 is immersed in cryogenic liquid 20 in the sump 22, which sump has a vacuum space 39 above the liquid 20. A fill line conduit 26 delivers the cryogenic fluid 20 through the use of the cryogenic fluid flow pump 24 from the underground cryogenic fluid tank 12 to an above-ground LNG fuel station 47. At the fuel station 47, a delivery conduit 29 delivers the fuel to an LNG powered vehicle 66 via inlet 76 into a vehicle two-compartment vapor-liquid storage tank 70, which tank has a vapor line 73 and a liquid line 72 that fuels an LNG engine 74, which storage tank is shown more particularly in U.S. patent application Ser. No. 08/450,085. The vehicle two-compartment storage tank has separate vapor and liquid compartments connected by a conduit, which conduit has a smaller cross-sectional area than the inlet 76, so that when the liquid compartment becomes substantially filled, the LNG fuel causes a rapid rise in pressure in the liquid compartment. The rise in pressure may be monitored and sensed by a pressure gauge in the liquid compartment or by the differential pressure between the vapor and liquid compartments. The rise in pressure (or change in the LNG flow rate associated therewith) is detected by a control system to stop the operation of the LNG pump.

A preheater 33 is positioned downstream from the pump 24. The heater has an immersion preheater 32 that preheats heating elements 35, and a heat thermocouple 34 shown positioned on the fill line conduit 26. A fail-close electropneumatic or hydraulic valve 62 is located in the sump vacuum space 39 downstream of the heater 33, which valve 62 is open during the cool-down operation or when filling two-compartment cryogenic fluid storage tank 70 on board the vehicle 66. A fail-safe open valve 64 is also located at the inlet of the heater 33 and has an exit 65 into the sump fluid volume 20. The fail-safe open valve 64 is a bypass valve that allows the pump 24 to operate a closed loop back to the sump fluid volume 20 without flowing through the rest of the system.

FIG. 3 shows in detail the sump 22 used in the method for delivery of a cryogenic fluid 20 from an underground tank 12 in FIG. 1. A pump 24 is immersed and positioned in a sump 22 filled with cryogenic fluid 20. As shown, the sump 22 operates within vacuum space 11 of the outer cryogenic fluid storage tank 38. A preheater 33 with an immersion preheater unit 32 and heating elements 35 heats the cryogenic fluid 20 from the pump 24 to a selected set temperature prior to delivery to the fuel station 47. The temperature of the cryogenic fluid 20 from the heater 33 is controlled by thermocouple 34. The fail-close electropneumatic or hydraulic valve 62 is shown located in the sump vacuum space 39 downstream of the heater 33, which valve 62 is open during the cool-down operation or when filling two-compartment cryogenic fluid storage tank 70 on board the vehicle 66. The fail-safe open valve 64 is shown located at the inlet of the heater 33 and has an exit 65 into the sump fluid volume 20. The fail-safe open valve 64 is a bypass valve that allows the pump 24 to operate a closed loop back to the sump fluid volume 20 without flowing through the rest of the system.

Figure 2:
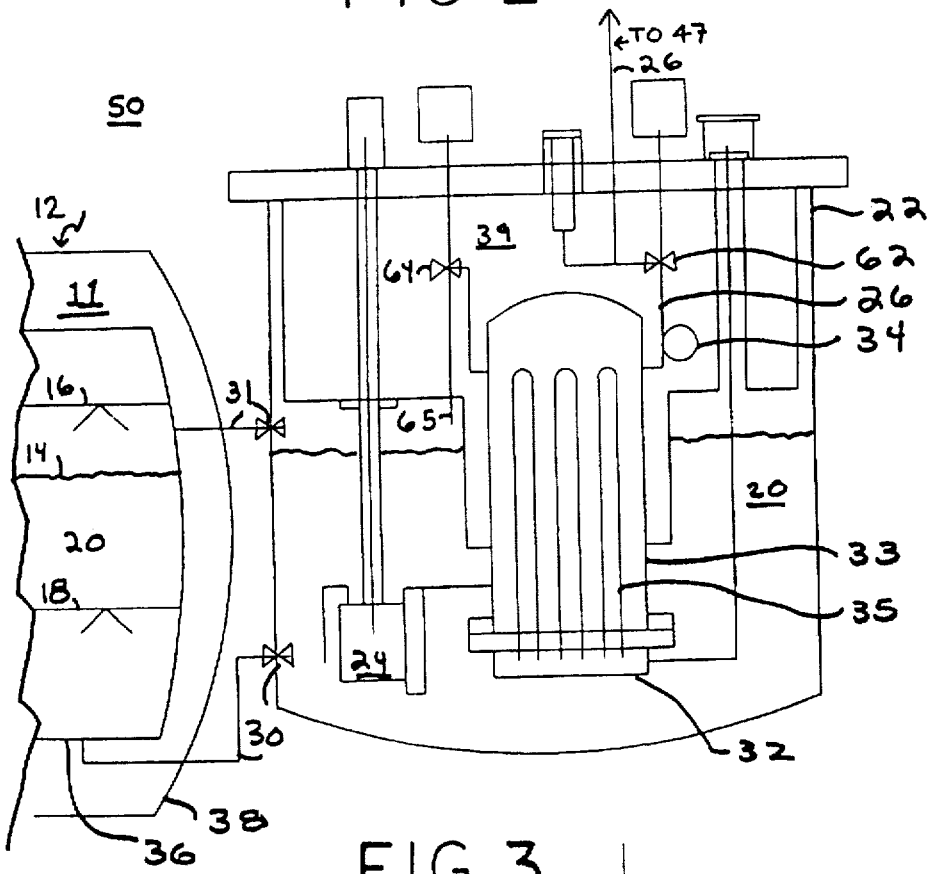
FIG. 2 is an enlarged sectional portion of another embodiment of the system of FIG. 1 illustrating a separate sump with the pump and preheater elements of the system.

FIG. 2 shows the sump 22 positioned separate from the outer tank 38. The pump 24 is immersed and positioned in a sump 22 filled with cryogenic fluid 20. In this embodiment, the sump 22 is shown independent and isolated from the main cryogenic fluid storage tank 38. A liquid fill conduit and liquid valve 30 isolates main cryogenic fluid storage tank 38 together with a vapor liquid fill conduit and vapor valve 31 at the top of the sump 22. A heater 33 with an immersion preheater 32 and heating elements 35 heats the cryogenic fluid 20 from the pump 24 to a selected set temperature prior to delivery to the fuel station 47. The temperature of the cryogenic fluid 20 from the heater 33 is controlled by thermocouple 34. The fail-close electropneumatic or hydraulic valve 62 is shown located in the sump vacuum space 39 downstream of the heater 33, which valve 62 is open during the cool-down operation or when filling two-compartment cryogenic fluid storage tank 70 on board the vehicle 66. The fail-safe open valve 64 is shown located at the inlet of the heater 33 and has an exit 65 into the sump fluid volume 20. The fail-safe open valve 64 is a bypass valve that allows the pump 24 to operate a closed loop back to the sump fluid volume 20 without flowing through the rest of the system.

In operation, the invention includes a method of delivering a cryogenic fluid, such as LNG, to a cryogenic fluid using system, such as an LNG engine, particularly an LNG operated vehicle like a truck. A storage tank, such as an underground storage tank for the storage of cryogenic fluid is used, and a pump for the pumping of the cryogenic fluid from the underground storage tank is immersed in a sump containing cryogenic liquid. Cryogenic fluid is pumped from the tank to a cryogenic fluid using system, such as an LNG vehicle. Optionally, the method includes immersing the pump in a sump which is independent from the underground storage tank, and which sump is insulated, and which optionally and preferably may include an immersion preheater with controls for the heating of the cryogenic liquid, so as to raise the saturated pressure of the cryogenic fluid from the underground storage tank to the desired pressure for the cryogenic using system.

What is claimed is:

1. A system for the delivery of a cryogenic fluid to a cryogenic-fluid-using source, which system comprises:

a) a tank source of cryogenic fluid having an outer tank and an inner tank with an insulated vacuum space there between;

b) a pump to deliver cryogenic fluid at a selected, saturated pressure from the tank source to a cryogenic-fluid-using source and positioned in said vacuum space;

c) a sump containing cryogenic liquid, said pump immersed in the cryogenic liquid in the sump; and d) conduit and valve means to connect the cryogenic fluid from the tank source through the pump in the sump to the cryogenic-fluid-using source.

2. The system of claim 1 wherein the cryogenic fluid comprises LNG fluid, and the cryogenic-fluid-using source comprises an LNG vehicle having an LNG engine.

3. The system of claim 1 wherein the tank source of cryogenic fluid comprises an underground tank source.

4. The system of claim 1 wherein the pump comprises a piston-type reciprocating double-action, negative-suction, positive displacement piston pump.

5. The system of claim 1 wherein the pump comprises a centrifugal pump.

6. The system of claim 1 which includes a heater downstream of the pump to heat the pumped cryogenic fluid to provide a cryogenic fluid of selected saturated pressure to the cryogenic fluid using source.

7. The system of claim 6 wherein the heater is in the sump and comprises a cryogenic fluid flow-through immersion heater.

8. The system of claim 7 wherein the immersion heater has a preheater positioned in the cryogenic liquid in the sump.

9. The system of claim 6 which includes a bypass conduit and valve means at an outlet of the heater to provide for the selected closed loop operation of the cryogenic liquid from the pump and bypass conduit back to the sump.

10. The system of claim 6 which includes a thermocouple downstream of the heater, to control the temperature of t cryogenic fluid to a predetermined set point.

11. The system of claim 7 wherein the sump includes a top flange, and wherein the heater is mounted to the top flange and is insulated by a vacuum in the space between the top flange and the heater in the sump.

12. The system of claim 10 which includes a fail-safe closed valve means located downstream of the thermocouple means to isolate the pump piping from above-ground piping, when the pump is not operating.

13. The system of claim 12 wherein the fail-safe valve means includes a drain valve to drain cryogenic liquid from connecting lines above the ground back to the tank source wherein the tank source is an underground tank source and the sump is an underground sump.

14. A system for the delivery of an LNG fluid to a cryogenic-LNG-using vehicle, which system comprises:

a) an underground tank source of the LNG cryogenic fluid;

b) a pump to deliver the LNG cryogenic fluid at a selected saturation pressure from the tank source to the storage tank in an LNG cryogenic fluid operated vehicle;

c) an underground sump connected to the underground tank source, the sump containing LNG cryogenic fluid and said pump totally immersed in the LNG cryogenic fluid;

d) a flow-through, immersion heater downstream of said pump and in the sump to heat the LNG cryogenic fluid from the pump to provide an LNG cryogenic fluid of selected saturated pressure for use by the LNG vehicle;

e) a thermocouple downstream of the heater to control the operation of the heater and the temperature of the LNG cryogenic fluid to the LNG vehicle;

f) conduit and valve means to connect the LNG cryogenic fluid in the tank source through the pump and heater to the LNG using vehicle; and g) bypass conduit and valve means at the outlet of the heater to provide for the selected closed loop passage of the LNG cryogenic fluid from the pump back to the sump.

15. The system of claim 14 wherein the underground tank source comprises a vacuum-insulated tank of an outer tank and an inner tank and a vacuum space between the inner and outer tank and said sump positioned within the vacuum space.

16. The system of claim 14 wherein the sump is positioned separately from the underground tank source.

17. The system of claim 14 wherein the sump includes a top flange, and wherein said heater is mounted to the top flange and insulated by a vacuum in the sump.

18. The system of claim 14 which includes a fail-safe valve means downstream of the thermocouple to isolate the conduit and valve means from the aboveground valves and conduits when the pump is not operating.

19. The system of claim 14 which includes a drain valve to drain LNG fluid from aboveground conduits back to the tank source.

20. The system of claim 14 which includes an LNG fuel station to receive pumped LNG fluid from the tank source.

21. The system of claim 14 wherein the pump comprises a piston-type, reciprocating, double action, positive displacement pump.

22. The system of claim 14 which includes an LNG fluid-operated vehicle and wherein the LNG storage tank of the vehicle includes a vapor compartment and a liquid compartment, an inlet for the introduction of LNG fluid into the liquid compartment, an overflow conduit of restricted, cross-sectional area between the lower portion of the vapor and upper portion of the liquid compartment, and a control means activated by an abrupt change in a parameter of the LNG fluid during filling of the liquid compartment to prevent overfilling of the storage tank.

23. A method for the delivery of a cryogenic fluid from a tank source having an outer tank and an inner tank and a vacuum space between the inner and outer tank to a cryogenic-fluid-using source, which method comprises:

a) positioning a vacuum-insulated sump in the vacuum space and immersing a delivery pump in cryogenic fluid in the sump; and b) pumping the cryogenic fluid from said tank source by said pump in the sump at a selected saturated pressure to a remote cryogenic-fluid-using source.

24. The method of claim 23 which includes heating the pumped cryogenic fluid to a selected temperature prior to delivery to the cryogenic-fluid-using source.

25. The method of claim 24 which includes controlling the temperature of the heated cryogenic fluid by employing a thermocouple.

26. The method of claim 23 which includes draining all connecting conduits from an aboveground cryogenic-fluid-using source back to the sump after completion of the pumping step.

27. The method of claim 23 wherein the cryogenic fluid comprises LNG, and which includes pumping the LNG into an LNG fuel station and vapor-liquid LNG storage tank on an LNG-using vehicle.

28. The method of claim 23 which includes heating the cryogenic fluid in a flow-through immersion heater in the sump directly downstream of the pump and vacuum-insulating the heater in the sump.

29. A method for the delivery of an LNG fluid to an LNG fueling station, which method comprises:

a) providing an underground tank source of LNG fluid;

b) pumping the LNG fluid, by a delivery pump, from the tank source to an LNG fueling station;

c) connecting an underground sump to the tank source, the sump containing LNG fluid, and immersing the delivery pump in the LNG fluid in the sump;

d) heating the pumped LNG fluid in a flow-through immersion heater in the sump to provide a heated, pumped, LNG fluid of controlled temperature and selected saturated pressure;

e) connecting the LNG fluid in the tank source by conduits and valves to an LNG fueling station at or above ground level; and f) providing a bypass conduit and valves to provide a closed loop passage of the LNG fluid from the pump to the sump.

30. A system for the delivery of a cryogenic fluid from a cryogenic fluid tank source, which system comprises:

a) an underground vacuum-insulated tank source of cryogenic fluid to be delivered;

b) an underground vacuum-insulated sump connected to and containing cryogenic fluid from the tank source, the sump containing:

i) a delivery pump for the cryogenic fluid and immersed in the cryogenic fluid of the sump; and ii) an immersion heater downstream of the pump and in the sump to heat the pumped cryogenic fluid to a selected saturated pressure;

c) means to control the temperature of the cryogenic fluid from the heater; and d) conduit and valve means to connect the heated, pumped, cryogenic fluid from the sump to a cryogenic delivery station.

31. The system of claim 30 wherein the heater comprises an electric heater secured to a top flange of the sump and insulated by a vacuum in the sump.

32. The system of claim 31 wherein the heater includes a preheater immersed in the cryogenic fluid in the sump.

33. The system of claim 30 wherein the cryogenic delivery station is at or above ground level.

34. The system of claim 30 wherein the tank source comprises and outer tank and an inner tank with a vacuum space between the inner and outer tank and the sump positioned in the vacuum space.

35. A delivery station for storing and dispensing cryogenic fluid to a use device comprising:

a) an insulated tank source of cryogenic fluid independent of the use device for securing and storing cryogenic fluid;

b) a sump containing cryogenic fluid from the tank source and independent of the use device;

c) a cryogenic delivery pump in the sump and submerged in the cryogenic fluid;

d) a cryogenic fluid heater in the sump and to heat pumped cryogenic fluid to a selected saturated pressure;

e) a conduit for conveying cryogenic fluid from the tank source to the sump; and f) a pump outlet conduit for conveying heated pumped cryogenic fluid to the use device.

36. The station of claim 35 wherein the tank source is an underground vacuum-insulated tank and the sump is vacuum-insulated and positioned in the vacuum space of the vacuum-insulated tank source.

37. The station of claim 35 wherein the sump is independent of the tank source.

38. The station of claim 35 wherein the tank source and sump are under ground and include a delivery station for the use device at or above ground.

* * * * *

UNITED STATES PATENT AND TRADEMARK OFFICE

CERTIFICATE OF CORRECTION

PATENT NO : 5,787,940

DATED : August 4, 1998

INVENTOR(S) : John W. Bonn and Anker Gram

It is certified that error appears in the above-identified patent and that said Letters Patent is hereby corrected as shown below:

On title page, under Related U.S. Application Data:

Delete "Continuation-in-part of Ser. No. 450,085, May 25, 1995, Pat. No. 5,551,448, which is a division of Ser. No. 294,084, Aug. 22, 1994, Pat No. 5,477,690, which is a division of Ser. No. 39,908, Mar. 30, 1993, Pat. No. 5,411,374."

Signed and Sealed this

First Day of December, 1998

*Attest:*

*Attesting Officer*

Bruce Lehman

BRUCE LEHMAN

*Commissioner of Patents and Trademarks*